US005158371A

United States Patent [19]

Moravek

[11] Patent Number: 5,158,371

[45] Date of Patent: Oct. 27, 1992

[54] SELF-SUPPORTING POLYMER BAG AND METHOD OF MANUFACTURE

[76] Inventor: Lawrence R. Moravek, 1919 Buckingham Dr., Wheaton, Ill. 60187

[21] Appl. No.: 529,474

[22] Filed: May 29, 1990

[51] Int. Cl.[5] ..... B65D 33/02

[52] U.S. Cl. ..... 383/104; 383/120; 383/121

[58] Field of Search ..... 383/104, 119, 121, 120; 229/117.03, 117.04, 117.05

[56] References Cited

U.S. PATENT DOCUMENTS

| | | | |
|---|---|---|---|
| 2,057,748 | 10/1936 | Smith | 383/104 |
| 2,271,962 | 2/1942 | Weiner | 229/117.05 |
| 2,650,016 | 8/1953 | McMillan | 383/10 X |
| 3,682,372 | 8/1972 | Rodley | 383/104 |
| 3,738,565 | 6/1973 | Ackley et al. | 383/104 |
| 4,848,931 | 7/1989 | Kamada et al. | 383/104 |
| 4,930,903 | 6/1990 | Mahoney | 383/104 X |

FOREIGN PATENT DOCUMENTS

| | | | |
|---|---|---|---|
| 2031718 | 4/1980 | United Kingdom | 383/119 |
| 2081676 | 2/1982 | United Kingdom | 383/104 |

*Primary Examiner*—Stephen Marcus
*Assistant Examiner*—Jes F. Pascua

[57] ABSTRACT

A flexible expandable plastic bag self-supporting when open with a rigidifying panel mounted for pivotal movement as the bag is snapped open.

5 Claims, 3 Drawing Sheets

SELF-SUPPORTING POLYMER BAG AND METHOD OF MANUFACTURE

BACKGROUND OF THE INVENTION

Retail shopping bags have gone through a significant evolution in the last 15 years from 100% brown paper with box bottoms, which are still popular today, to a variety of paper-plastic composite bags and all plastic bags having integral and separate handles.

Most of today's all plastic retail shopping bags are constructed of extruded polyethylene having thicknesses from less than 1 mil. up to 5 or 6 mils. In this thickness range, the bags will not stand erect and must be manually opened to insert the product at the sales location. In some cases, bag racks have been devised for holding these plastic bags open during loading such as illustrated in the Jenkins, U.S. Pat. No. 4,723,743, Provan, U.S. Pat. No. 4,487,388, and the Malik, U.S. Pat. No. 4,498,652.

While these wire form racks work quite well, they require additional counter space and, of course, add significantly to the overall containerizing cost.

It is a primary object of the present invention to provide a flexible plastic container that ameliorates the problems in prior containers noted above.

SUMMARY OF THE PRESENT INVENTION

In accordance with the present invention, a self-supporting flexible plastic bag is provided that when open at the reatil counter, will stand and remain in an open condition as the clerk loads product therein.

Toward this end, the present flexible plastic bag is provided with a pivotally mounted rectangular rigidifying panel that pivots from a bag collapsed position as the bag is snapped open to a position overlying the bottom wall of the bag. As the bag is snapped open, utilizing air pressure to assist in opening the bag which of course is a common procedure, air is caught behind this rigidifying panel pivoting it downwardly and assisting in opening the bag and squaring the bottom of the bag.

This rigidifying panel, which may be either paperboard or even a plastic panel constructed of the same material as the bag, is particularly useful in plastic bags having bottom gussets. This type of bag includes in collapsed configuration front and rear panels connected along their side edges (no separate side panels) and an interiorally projecting single gusset that runs from one side to the other at the bottom. This gusset is attached at its side edges to the front and rear panels. Without the rigidifying panel, this bag structure is conventional and as the bag is snapped through the air in a bag opening movement, the bottom gusset opens into a mostly flat configuration defining a rectangular bag bottom wall and the side portions of the forward and rear panels move orthogonally to form the bag sides.

An important aspect of the present invention is its method of manufacture that includes folding a polymer sheet along its mid-line, forming a gusset with a roller along the fold line and attaching the rigidifying panels to the sheet either before or after folding so the panels are connected only one side of the gusset so that in the bag collapsed position, it is parallel with the front and rear panels discussed above. The rigidifying panel is shorter than the width of the collapsed bag and is sized so that it is approximately the same size as the bag bottom wall after the bag has been opened.

Thereafter handle holes may be cut into the folded web at a cutting station and the side edges of the front and rear panels and the sides of the gusset are attached together by heat sealing and cutting or hot wire sealing and separation.

Other objects and advantages of the present invention will appear more clearly in the following detailed description.

DETAILED DESCRIPTION OF THE PREFERRED EMBODIMENT

Figure 1:
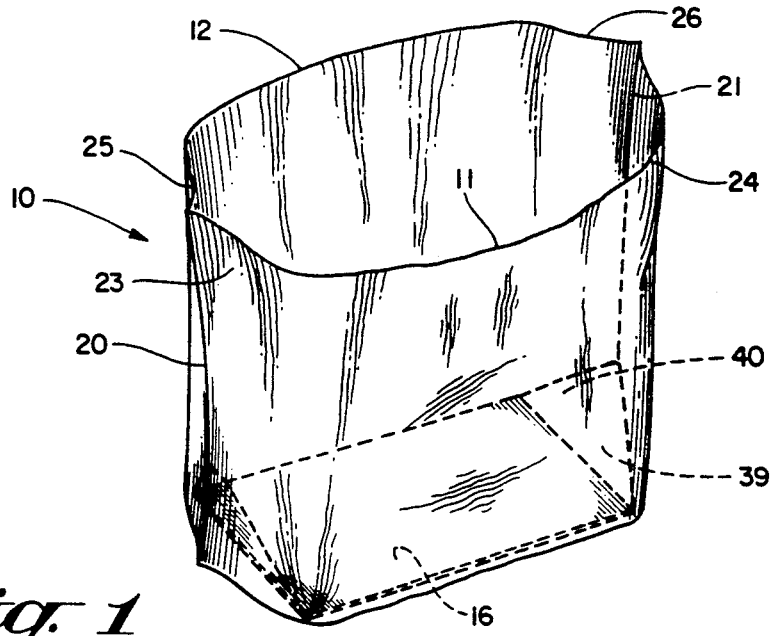
FIG. 1 is a perspective view of a gusset bag according to the present invention in its erect and open position.
Figure 2:
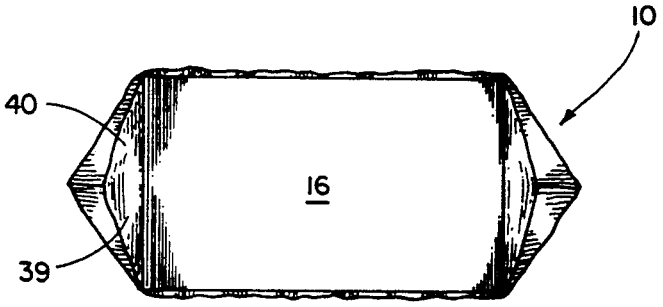
FIG. 2 is a top view of the bag illustrated in FIG. 1 with the side walls not completely square.
Figure 3:
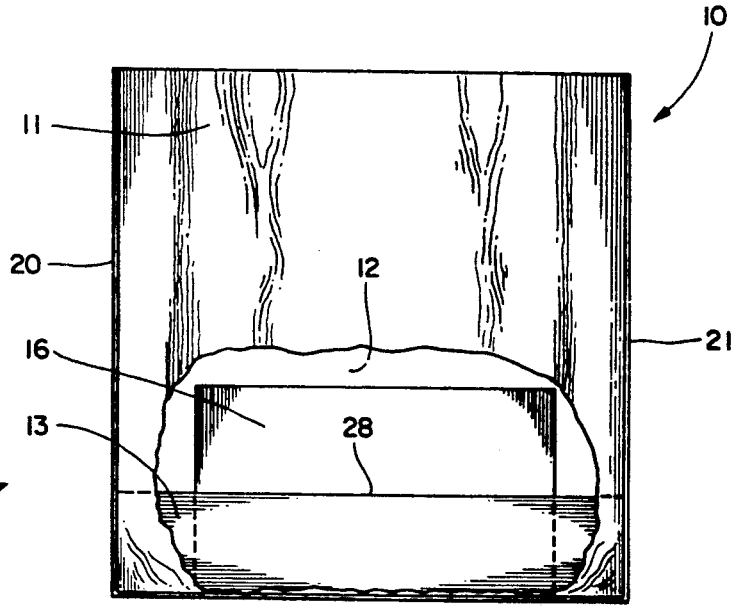
FIG. 3 is a front view of the bag illustrated in FIGS. 1 and 2 in its collapsed position with its front panel broken away to show the interior gusset and rigidifying panel.

Referring to the drawings and particularly FIGS. 1 to 3, a flexible polymer bag 10 is illustrated consisting generally of a front panel 11, a rear panel 12, a bottom gusset 13, and a rectangular rigidifying panel 16 fixed to one side of the gusset 13.

Figures 6, 7:
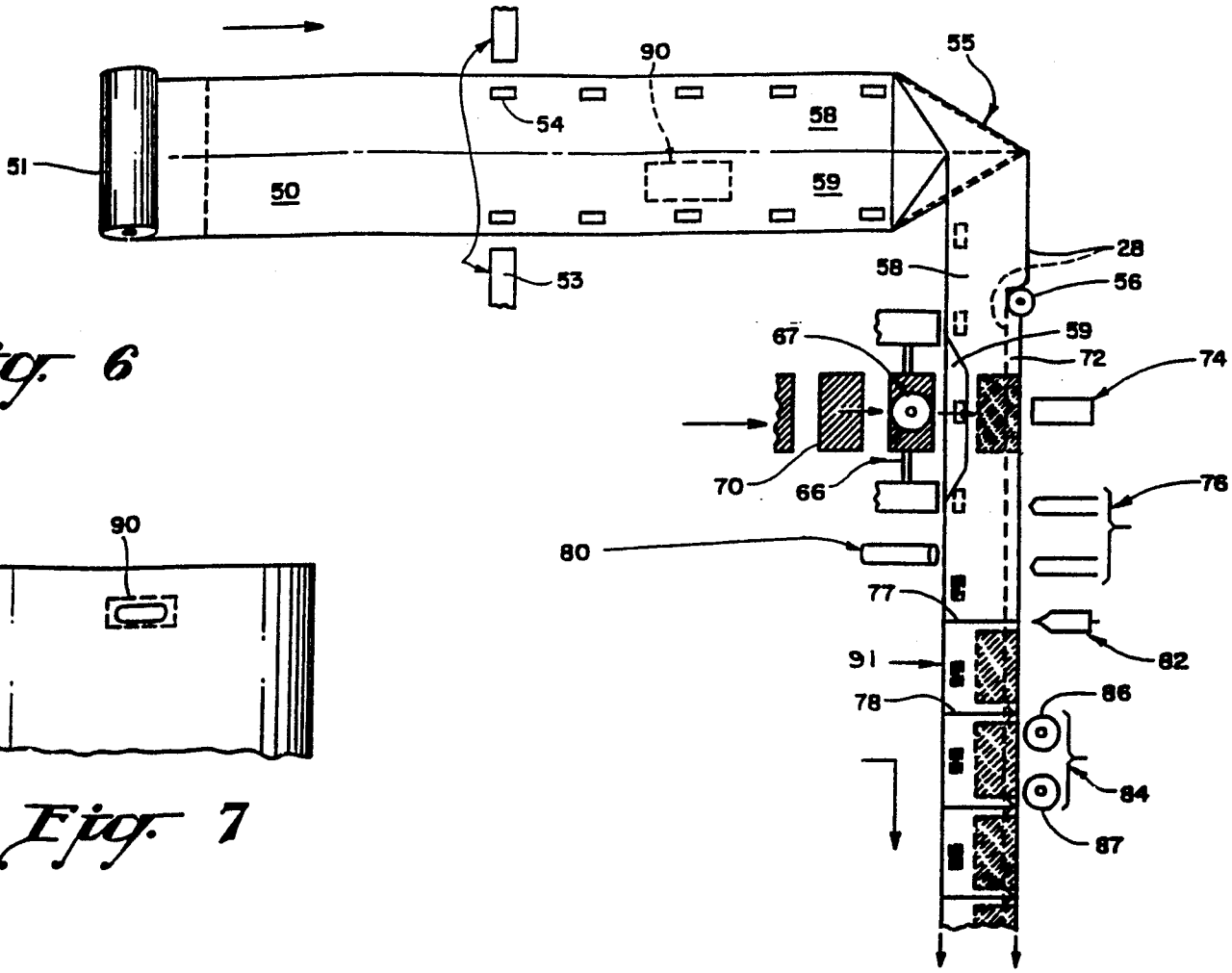
FIG. 6 is a diagrammatic top view of the method of forming and manufacturing the present bag.
FIG. 7 is a fragmentary perspective of a handle resulting from the method illustrated in FIG. 6.

The front panel 11, rear panel 12 and gusset 13 are manufactured from a single web of high or low density polyethylene, or an equivalent plastic, by the method of FIG. 6, typically in the range of ½ mil. to 15 mils. The rigidifying panel 16 may be constructed of either paperboard or paper in the range of 0.0005 to 0.010 inches or thicker or may even be of similar plastic material to the bag and in either case it should be stiffer than the material from which the bag is constructed.

The bag is illustrated in its collapsed position in FIG. 3 and in its expanded or erect position in FIG. 2, and viewing FIG. 3 initially for the construction of the bag, it is seen that front panel 11 and rear panel 12 have equal dimensions and are heat sealed at 20 and 21 along their side edges. When opened, the side portions 23 and 24 of the front panel 11 and side portions 25 and 26 of the rear panel 12 become the side walls of the bag. Note that the heat seal lines 20 and 21 extend completely from the top to the bottom of the bag in both the collapsed condition illustrated in FIG. 3 and the open position illustrated in FIGS. 1, 2 and 4.

Figure 5A:
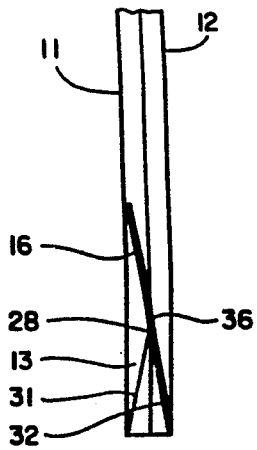
FIGS. 5*a*, 5*b* and 5*c* are side diagrammatic views of the container illustrating the movement of the gusset and rigidifying panel as the bag is snapped open.

As will appear from the FIG. 6 method, the front and rear panels 11 and 12 and the gusset 13 are constructed from a single sheet by first folding the sheet over and then displacing the resulting fold line 28 upwardly between the panels forming a gusset 13 as seen in FIG. 5*a* with a forward panel 31 and a rear panel 32, and it should be understood that the front and rear gusset panels 31 and 32 extend completely across the front and rear panels 11 and 12 in the collapsed condition and are connected to the front and rear panels by the heat seal lines 20 and 21.

The depth of the gusset 13 of course controls the forward to rear dimension of the bag when in its open position illustrated in FIGS. 1, 2, 4 and 5*c*.

Figure 4:
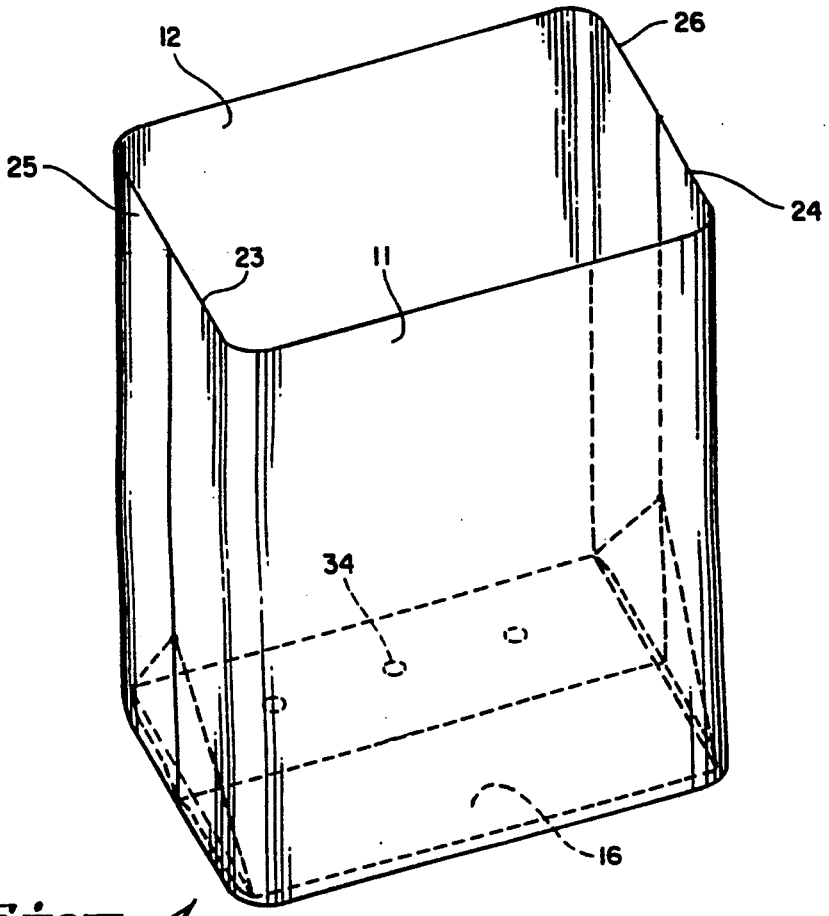
FIG. 4 is a somewhat schematic and idealized perspective of the bag illustrated in FIGS. 1 to 3 showing the heat sealing lines.

As seen in FIG. 4, the rigidifying panel 16 is connected to the inner face of the rear gusset panel 32 by three glue spots 34 although heat sealing techniques could be utilized as well.

Figure 5B:
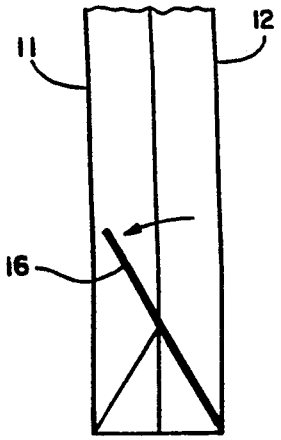

An important aspect of the present invention and as seen in FIGS. 5*a* and 5*b* is that the rigidifying panel is only fixed to the rear gusset panel 32 and not to either the rear panel 12 or the front gusset panel 31. In this way it pivots with the rear gusset panel, and in fact assists in pivoting and opening the gusset and bag as it is opened.

Figure 5C:
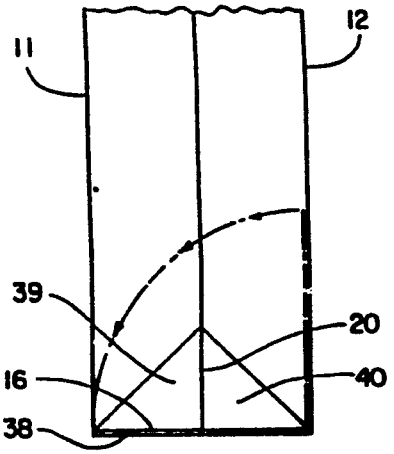

The opening movement is shown sequentially in FIG. 5*a*, 5*b* and 5*c* from the collapsed bag illustrated in FIG. 2 as it is snapped through the air in a bag opening movement. As air begins to fill the bag as seen in FIG. 5*a*, air will impinge on surface 36 of the rigidifying panel 16 causing it to pivot counter-clockwise with the rear gusset panel 32. The rigidifying panel thereby acts somewhat like a piston in opening both the gusset 16 and spreading the front and rear panels 11 and 12 into a rectangular configuration forming the bag side walls. Thus, in addition to rigidifying the bag, panel 16 actually assists in opening both the gusset and front and rear panels 11 and 12.

With the bag fully open as illustrated in FIG. 5*c*, the rigidifying panel 16 overlies and is in engagement with bag bottom wall 38 defined by the central portions of the front and rear gusset panels 31 and 32. Note that the end portions 39 of the front gusset panel 31 and the end portions 40 of the rear gusset panel 32 form triangular folds contiguous with the container side walls (also see FIGS. 1 and 2) because the lateral ends of the panels 31 and 32 are fixed to the front and rear panels along the vertical heat seal lines 20 and 21.

The resulting open bag stands completely alone without assistance as seen in FIGS. 1 and 4 ready for bag loading without the use of any racks or wire forms.

Referring now to the method of manufacture of the bag 10 illustrated in FIGS. 1 to 5*c*, the container is made from a single web of plastic sheeting 50 fed either from a roll 51 or preferably directly from an extruder (not shown). At the first station 53, handle reinforcing plastic sheet panels or patches 54 are attached to the sheet at the eventual handle die cut locations. Next an A-frame web folding station 55 folds the sheet 50 at its mid-line and directs it in an orthogonal direction to a gusset forming roller 56 that forms gusset 13 by reversing the fold line 28 between top web portion 58 and bottom web portion 59.

At station 66, a panel feed wheel 67 indexes to insert rigidifying panels 70 with pre-applied adhesive between the sheet portions 58 and 59 underneath the gusset 72. Prior to insertion, glue applicator station 74 applies hot or cold glue spots to the panels. Alternately, a double sided tape can be applied to the panels prior to insertion into the gusset.

Thereafter a heat seal station 76 forms transverse seal lines 77 and 78 simultaneously and at the same location a handle cutting station 80 cuts an oblong hole through both upper and lower sheet portions 58 and 59 at the overlying handle cardboards 54. At the same time the bags are severed at a cutting station 82 and thereafter separated by a bag separator 84 that includes differential speed feed rollers 86 and 87. Thereafter the bags are stacked in what is the collapsed configuration illustrated in FIG. 3. The resulting handle assembly 90 is illustrated in FIG. 7.

Alternative locations for the panel insertion station are within the scope of this invention. For example the panel can be installed on the web 50 prior to the folding station A and prior to gusseting as illustrated by alternate panel insertion station 90 in FIG. 6. This is a preferred location because it minimizes the mechanical considerations when panels are inserted after folding. In process is where the containers are formed directly from a sheet extruder, a gusset is formed while the film is still in the extruder by a "post gusseter". In this case the panels 70 could be attached on the extrusion line prior to the "A" frame folding station followed by heat sealing and separation of the sheet material into individual bags. Furthermore, the panels 70 could be inserted with somewhat more difficulty at station 91 in FIG. 6 after cutting.

I claim:

1. An air opening self-standing flat bottom bag with bottom gusset, comprising: a front panel and a rear panel attached along their side edges contiguous in a collapsed bag position and forming bag side walls in a bag erect position, a gusset interconnecting the front and rear panels along their bottom edges having first and second relatively foldable bottom panels forming a bag bottom wall in the bag erect position, said panels and gusset being sufficiently thin so the bag is air opening, means for opening the bag and spreading the bag side walls apart and for positioning the first and second bottom panels perpendicular to the side walls and for opening and forming three perpendicular fold lines at each of the four corners between the side walls and bottom wall and for reinforcing the bag after it is fully opened so it stands erect including a thin, flexible panel having a thickness less than approximately 0.015 inches to provide the necessary flexibility attached to one of the bottom panels in an area spaced from the sides of the one bottom panel so it is unhingedly connected thereto and is pulled by the one bottom panel as the bag is moved from a collapsed bag position to a bag erect position as air fills the bag, said flexible panel having a length and width equal to length and width of the desired bag bottom wall, and said means to open the bag including means to shift the flexible panel automatically by air pressure from the bag collapsed position to the bag erect position including the attachment, size and thickness of the flexible panel so that as the user swings the collapsed bag through the air, the air pressure panel will flex under flexible opening the bag and forming the three bag corner fold lines at the four corners.

2. A self-standing flat bottom bag with bottom gusset as defined in claim 1, wherein the front and rear panels and gusset are formed from a single web of thin flexible plastic sheet, said flexible panel being constructed of a material stiffer than the thin flexible plastic sheet.

3. An air opening self-standing flat bottom bag with bottom gusset, comprising: a front panel and a rear panel attached along their side edges contiguous in a collapsed bag position and forming bag side walls in a bag erect position, a gusset interconnecting the front and rear panels along their bottom edges having first and second relatively foldable bottom panels forming a bag bottom wall in a bag erect position, said panels and gusset being sufficiently thin so the bag is an air opening container, means for opening the bag and spreading the bag side walls apart and for positioning the first and second bottom panels perpendicular to the side walls and for opening and forming three perpendicular fold lines at each of the four corners between the side walls and bottom wall and for reinforcing the bag after it is fully opened so it stands erect including a thin, flexible panel having a thickness less than approximately 0.015 inches to provide the necessary flexibility attached to one of the bottom panels in an area spaced from the sides of the one bottom panel so it is unhingedly connected thereto and is pulled by the one bottom panel as the bag is moved from a collapsed bag position to a bag erect position as air fills the bag, said flexible panel having a length and width equal to length and width of the desired bag bottom wall, and said means to open the bag including means to shift the flexible panel automatically by air pressure from the bag collapsed position to the bag erect position including the attachment, size and thickness of the flexible panel so that as the user swings the collapsed bag through the air, the flexible panel will flex under air pressure opening the bag and forming the three bag corner fold lines at the four corners.

4. A self-standing flat bottom bag with bottom gusset as defined in claim 3, wherein the front and rear panels and gusset are formed from a single web of thin flexible plastic sheet, said flexible panel being constructed of a material stiffer than the thin flexible plastic sheet.

5. A method of making an air opening self-standing flat bottom bag with bottom gusset, including the steps of: forming front and rear panels attached along their side edges contiguous in a collapsed bag position and defining bag side walls in a bag erect position, forming a gusset defined by relatively foldable first and second bottom panels interconnecting the front and rear panels along their bottom edges defining a bag bottom wall in the bag erect position, said front and rear panels and gusset being sufficiently thin so the bag is air opening, and attaching a thin, flexible panel having a thickness less than approximately 0.015 inches to one of the bottom panels in an area spaced from the sides of the one bottom panel so the flexible panel is unhingedly connected to the one bottom panel and is pulled by the one bottom panel as the bag moves from a collapsed bag position to a bag erect position under air pressure.

* * * * *